US005823169A

United States Patent [19]

Strohl et al.

[11] Patent Number: 5,823,169

[45] Date of Patent: Oct. 20, 1998

[54] AGGREGATE FOR FEEDING FUEL FROM SUPPLY TANK TO INTERNAL COMBUSTION ENGINE

[75] Inventors: Willi Strohl, Beilstein; Georg Haeussler, Ditzingen; Jochen Rose, Hemmingen; Oliver Wahl, Schwieberdingen; Erich Eiler, Sachsenheime, all of Germany

[73] Assignee: Robert Bosch GmbH, Stuttgart, Germany

[21] Appl. No.: 841,152

[22] Filed: Apr. 29, 1997

[30] Foreign Application Priority Data

May 8, 1996 [DE] Germany ..... 196 18 452.5

[51] Int. Cl.[6] ..... F02M 37/04

[52] U.S. Cl. ..... 123/516; 123/514; 417/435; 137/543.19

[58] Field of Search ..... 123/516, 514, 123/495, 509; 137/197, 199, 543.19, 540, 539, 315; 417/435

[56] References Cited

U.S. PATENT DOCUMENTS

| | | | |
|---|---|---|---|
| 4,159,726 | 7/1979 | Mette | 137/199 |
| 4,666,058 | 5/1987 | Harris | 137/43 |
| 4,739,898 | 4/1988 | Brown | 137/43 |
| 4,854,343 | 8/1989 | Rilett | 137/543.19 |
| 4,972,869 | 11/1990 | Takasaki | 137/199 |
| 5,039,284 | 8/1991 | Talaski | 417/435 |
| 5,065,790 | 11/1991 | Kornas | 137/543.19 |
| 5,353,834 | 10/1994 | Schmitt | 137/543.19 |
| 5,651,347 | 7/1997 | Oi | 123/516 |
| 5,655,892 | 8/1997 | Cherniawski | 417/435 |
| 5,680,848 | 10/1997 | Katoh | 123/516 |

FOREIGN PATENT DOCUMENTS

3540260A1 5/1987 Germany .

*Primary Examiner*—Carl S. Miller
*Attorney, Agent, or Firm*—Michael J. Striker

[57] ABSTRACT

An aggregate for feeding fuel from a fuel supply tank to an internal combustion engine, the aggregate has a housing through which fuel flows, a feeding pump and a motor which drives the pump, the feeding pump and the motor being arranged in the housing so that behind the feeding pump as considered in a flow direction a pressure chamber limited by the feeding pump is provided, a valve communicating the pressure chamber with an outer chamber, the valve having a closing element which during a normal operation of the feeding aggregate is held in a closing position so that the pressure chamber is separated from the outer chamber, the valve having a first passage with a first fluid flow and communicating the pressure chamber with the outer chamber, a second passage with a second fluid flow flowing around the closing element and leading in a joint opening toward the outer chamber, so that with increasing first fluid flow before and after the closing element as considered in the closing direction a pressure difference is formed and the closing element is transferable from an opening position to a closing position.

21 Claims, 7 Drawing Sheets

AGGREGATE FOR FEEDING FUEL FROM SUPPLY TANK TO INTERNAL COMBUSTION ENGINE

BACKGROUND OF THE INVENTION

The present invention relates to aggregates for feeding fuel from a supply tank to an internal combustion engine.

Feeding aggregates of the above mentioned general type are known in the art. One of such feeding aggregates is disclosed for example in the German document DE 35 40 260 A1 and has a housing through which fuel flows and which accommodates a feeding pump and a motor driving the pump. A pressure chamber is formed behind the feeding pump in the flow direction of fuel. These pressure chamber is openable and closeable by a valve toward a suction side of the pump. During the operation of the internal combustion engine, the excessive fuel supplied to the machine is returned into the supply tank for safety reasons. However, it is substantially warmed up. The warmed fuel gasses there out. When the internal combustion engine operates, this situation is not important. However, when the internal combustion engine is stopped after a long operational time and the whole tank content is warmed up, a vapor or gas cushion is formed in the feeding aggregate and finally fills the total pressure chamber of the fuel aggregate. In order to withdraw the gas which is formed in this pressure chamber when the aggregate is not in operation and to guarantee a fast fuel feeding after the start of the aggregate, the valve is provided with a passage which connects the pressure side of the pump with its suction side. The passage at the pressure side is provided with a seat for a closing element. The closing element at the pressure side of the passage is arranged movably between a closing position and an opening position.

During subsequent turning on of the fuel aggregate the gas also must be withdrawn from the conduit system. For this purpose when the feeding aggregate is stopped, the passage of the valve is open and vapor can move to the suction side of the feeding pump. When the feeding pump however is brought in operation, both fuel and also vapor or gas cushion located in the fuel are transported. The closing element is moved by the feeding of the fuel directly to a closing position. Thereby the gas which is located in the feeding pump as well as in the pressure chamber can not escape through the valve to the suction side of the feeding pump. Thereby the supply of the internal combustion engine with fuel is delayed. This is especially the case when the fuel level is located above the feeding aggregate arranged in the fuel tank in a standing position. Since the valve is completely surrounded by fuel, after a short feeding time a closing of the valve occurs, so that the vapor or gas cushion located in the feeding aggregate can not escape to the suction side of the feeding aggregate. Such a fluid-controlled valve is closed too fast during turning-on of the fuel feeding aggregate, so that a delay of the supply of the internal combustion engine with fuel can occur because of the remaining vapor or gas cushion.

SUMMARY OF THE INVENTION

Accordingly, it is an object of the present invention to provide a fuel feeding aggregate which avoids the disadvantages of the prior art.

In keeping with these objects and with others which will become apparent hereinafter, one feature of present invention resides, briefly stated, in an aggregate for feeding fuel from a fuel supply tank to an internal combustion engine, in which in accordance with the present invention, the valve has a first passage connecting the pressure chamber with an outer chamber and providing a fluid flow Q1, a second passage with a fluid flow Q2 and leading in a joint opening to the outer chamber, so that with increasing liquid flow Ql before and after the closing element as seen in the closing direction, a pressure difference is built up and the closing element is transferable from an opening position into a closing position.

By transferring the closing element from the opening position into the closing position because of the pressure difference which is built up in the valve, a closing movement of the valve relative to conventional ventilation valves can be delayed independently from the filling level of the fuel container, and it is directly transferred to a closing position by the throughflow of fuel. Thereby the suction conditions and in particular the heat heat start conditions of the feeding aggregate are improved, since the closing time of the valve is delayed. The vapor or gas cushion formed in the feeding pump can be withdrawn to the valve, since after a predetermined time a fluid stream can flow directly through the valve from the pressure chamber into the outer chamber to the suction side of the feeding aggregate. Moreover, the time-delayed closing movement of the closing element improves the noise condition.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
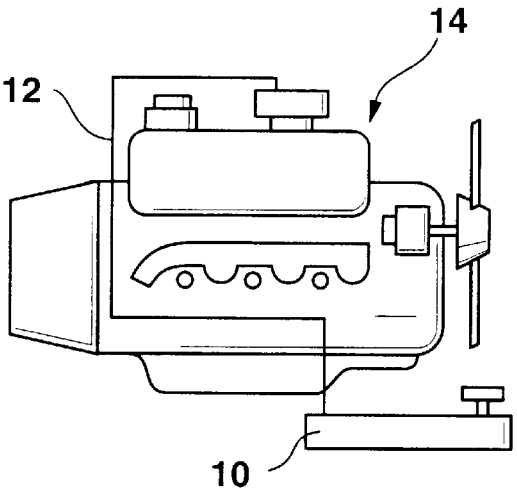
FIG. 1 is a view schematically showing an arrangement with an internal combustion engine and with a fuel supply tank in a not visible fuel feeding aggregate in accordance with the present invention.

FIG. 1 shows a fuel supply tank 10 arranged in a fuel feeding aggregate which is not shown here. A feeding conduit 12 is connected with the fuel feeding aggregate for supplying an internal combustion engine 14 with fuel when the feeding aggregate operates.

Figure 2:
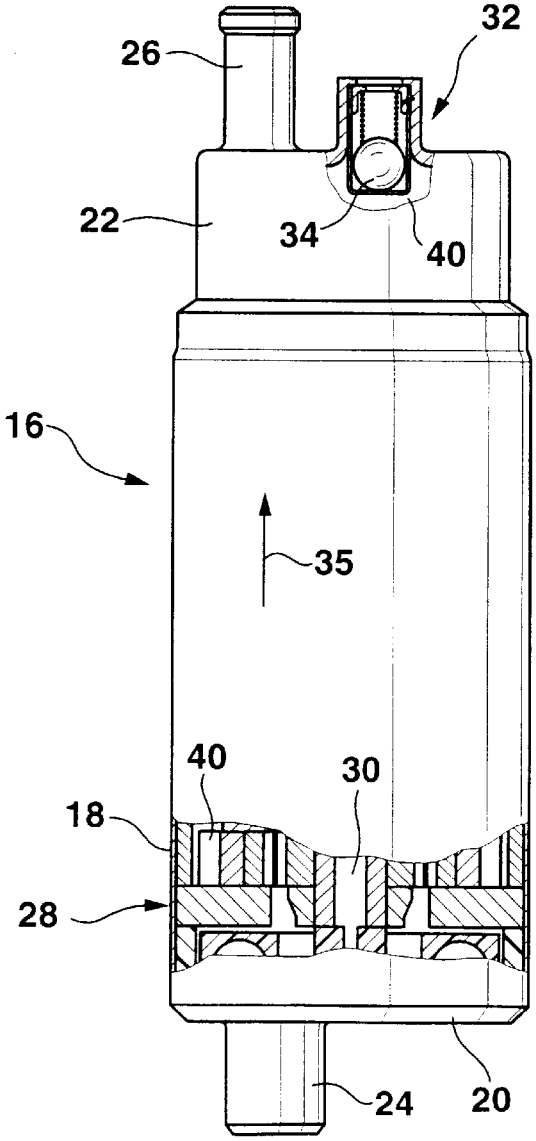
FIG. 2 is a view showing a fuel feeding aggregate which is not in operation in the arrangement of FIG. 1 on an enlarged view and partially sectioned.
Figure 4:
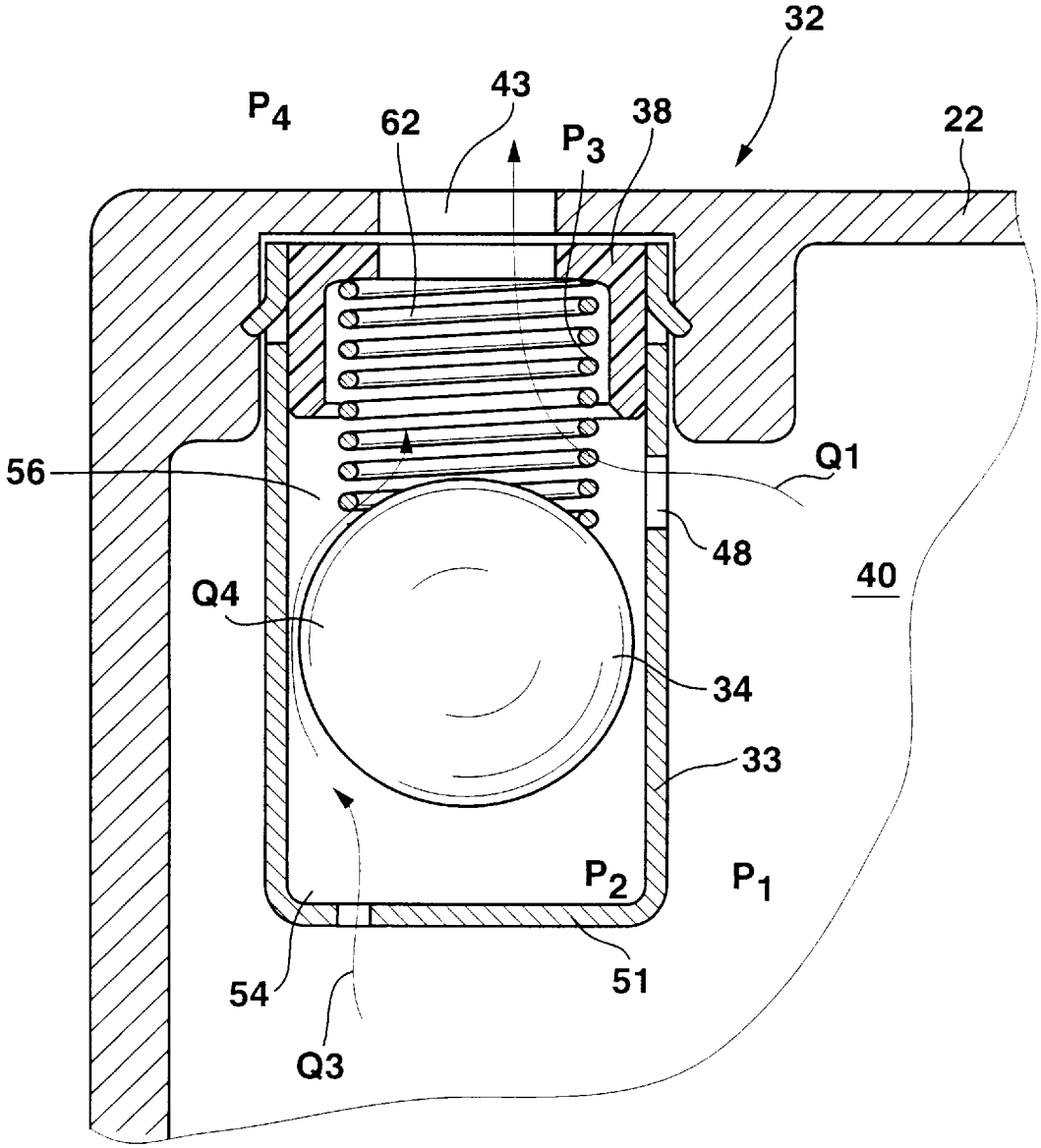
FIG. 4 is a view substantially corresponding to the view of FIG. 3, but showing the valve during a closing movement.
Figure 5:
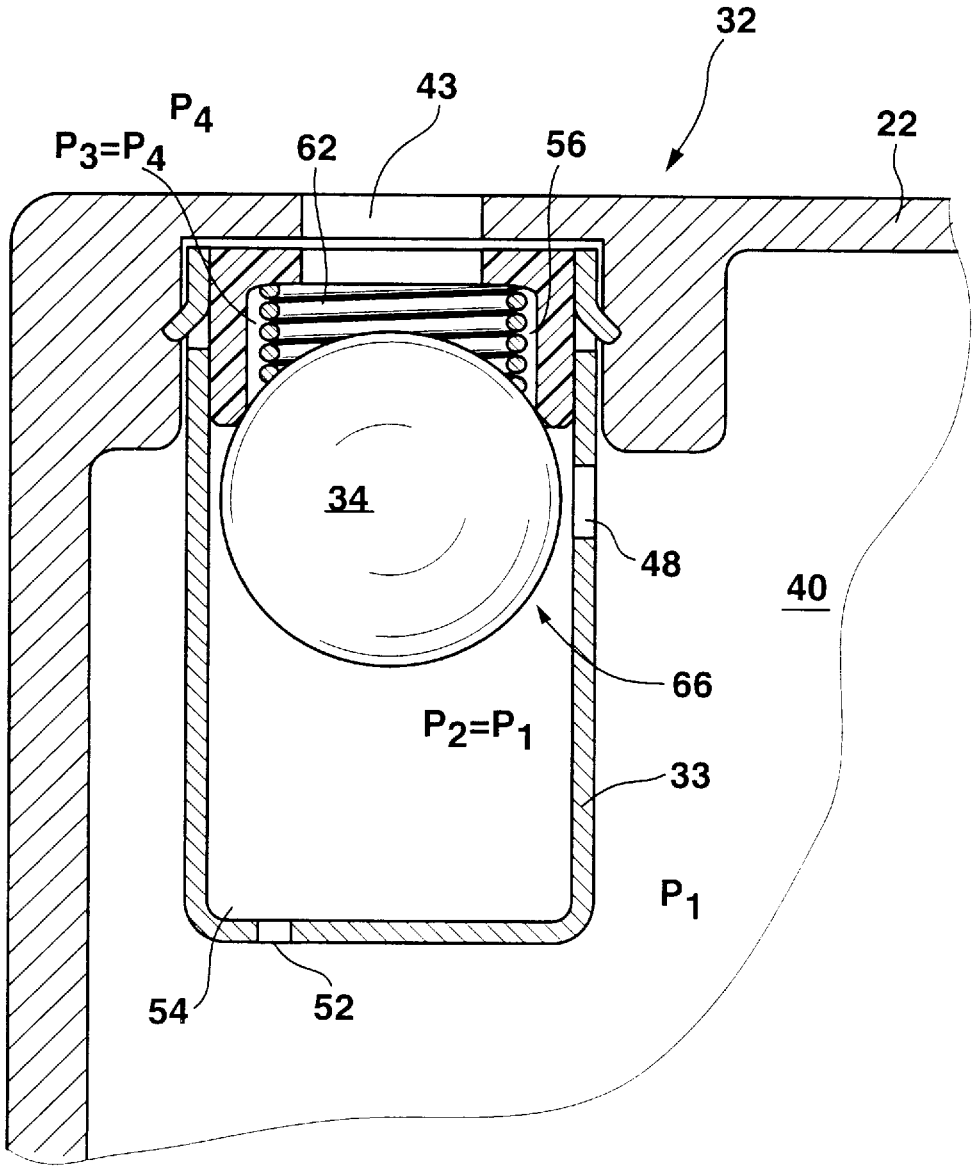
FIG. 5 is a view substantially corresponding to the view of FIG. 3, but showing the valve in a closing position.

FIG. 2 shows a fuel feeding aggregate 16 which is used for supply of the internal combustion engine 14 and can be arranged in a fuel supply tank. The fuel feeding aggregate has a housing 18 which is tubular. The both open ends of the tubular housing 18 are closed by housing covers 20 and 22. The housing cover 20 has a suction pipe 24. The housing cover 22 has a pressure pipe 22. A feeding pump 28 is arranged near the suction pipe 24 in the interior of the housing 18 with the housing covers 20 and 22. The feeding 20 and 28 is composed of two stages. It is driven by an electric motor with an armature shaft 30 shown in FIG. 2. The housing cover 22 has a specially designed valve 32 formed as shown in FIGS. 3–5.

The fuel to be supplied flows through the housing 18 of the feeding aggregate 16 from the suction pipe 24 to the pressure pipe 26 in direction of the arrow 35. The feeding pump 28 on the one side limits a pressure chamber 40 which is under a feeding pressure and formed between the feeding pump 28 and the housing cover 22. The electric motor is also located in this pressure chamber 40 through which fuel flows.

Figure 3:
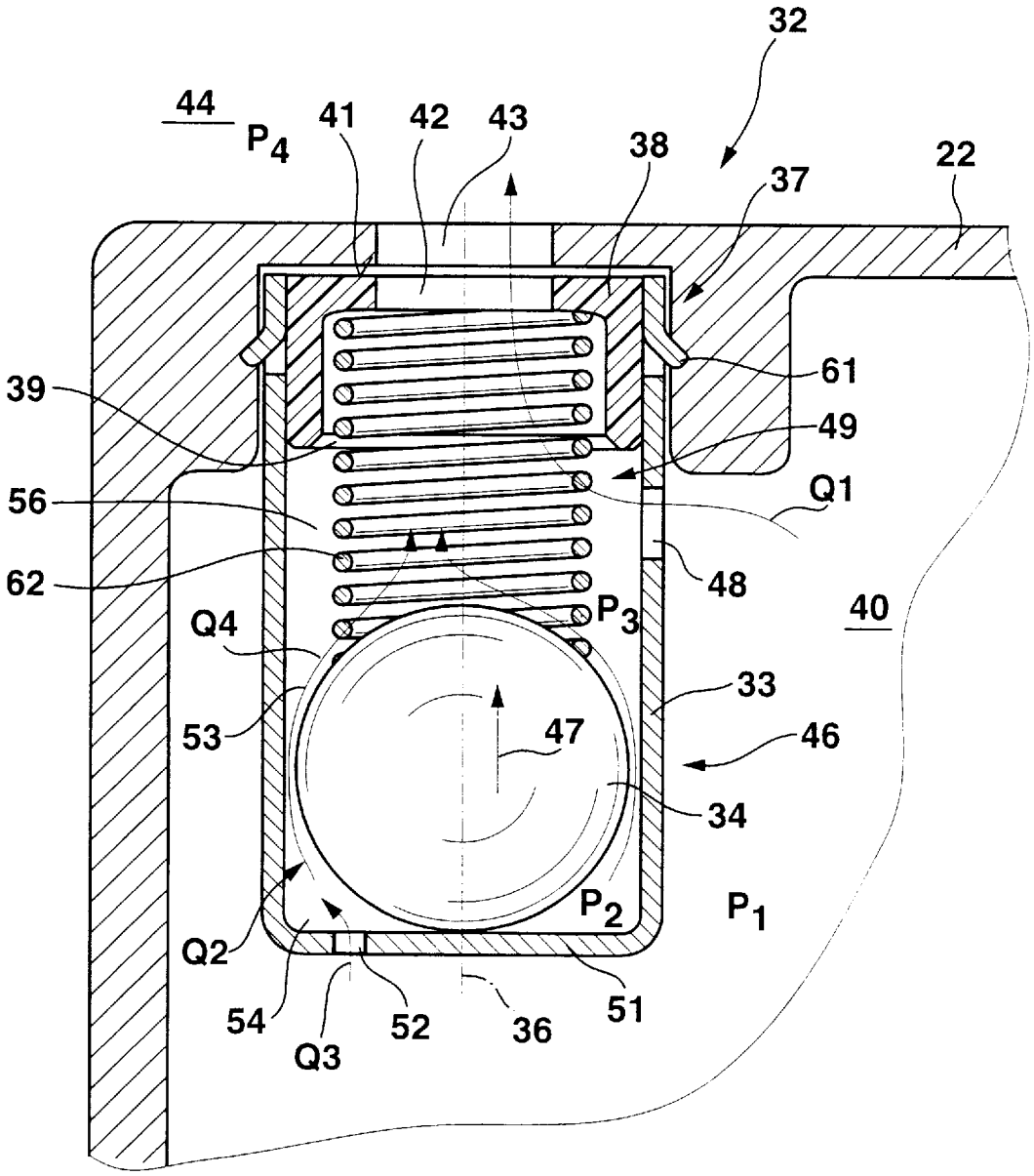
FIG. 3 is a schematic and enlarged sectional view of a valve of the inventive fuel feeding aggregate in an opening position.

The valve 32 arranged in the housing cover 22 is shown on enlarged scale in FIG. 3 and in a cross-section. The valve 42 has a cup-shaped housing 33 which can be composed of synthetic plastic or metal. A closing element 34 is arranged in the housing and formed as a ball. The closing element 34 can be also composed of synthetic plastic or metal. The housing 33 forms a guide of the closing element 34 and the diameter of the closing element 34 is at least insignificantly smaller than the inner diameter of the housing 33. The housing 33 in a cross-section to a longitudinal axis 36 of the valve 32 can have a square, polygonal, preferably round cross-sectional shape. The ratio of the inner diameter of the housing 33 and the outer diameter of the closing element 34 or the cross-section area of the closing element 34 can be formed in dependence on the desired time delay, as will be explained hereinbelow.

An insert 38 with a valve seat 39 is arranged at an open end 37 of the housing 33. The insert 38 has an opening 42 in its bottom 41. This opening preferably corresponds to the diameter of an opening 43 of the housing cover 22. Thereby the pressure chamber 40 is connectable with an outer chamber 44 or with the fuel supply tank. The closing element 34 in FIG. 3 is arranged in the housing 32 in an opening position 46.

The housing 33 in the region of the open end 37 is provided with arresting or snapping elements 61 for mounting the housing in a simple manner to the housing cover 22. The arresting elements 61 are formed preferably as latches which provide a clipping or arresting connection in the mounted position with the housing cover 22. Thereby a simple and fast mounting as well as cost-favorable design of the valve 32 is provided.

The valve 32 shown in FIG. 3 has restoring means 62 formed for example as a pressure spring. Such a restoring means 62 is used for example in a lying arrangement of the fuel feeding aggregate 16. With a standing arrangement such a restoring means 62 can be provided, but it is not necessary. Such a restoring means 62 can be also a parameter for the time-delayed closing of the valve 32.

FIGS. 3–5 show the valve 32 during a closing movement. In FIG. 3 the closing element 34 is shown in an opening position 46. In FIG. 4 the valve 32 is shown during a closing movement and in FIG. 5 the closing element 34 is located in a closing position 66. Subsequently, a closing process and pressure conditions before and after the closing elements 34 are explained. This information is related to the closing movement in accordance with the arrow 47 of the closing element 34, and before the closing element 34 with the region between the closing element 34 and the valve seat 39. An opening 48 is provided before the closing element 34 in the outer surface of the cup-shaped housing 33. This opening 48 in connection with the opening 43 of the housing cover 22, form a first passage 49 in which a fluid flow Ql can flow from the pressure chamber 40 to the outer chamber 44. An opening 52 is provided behind the closing element 34 in the bottom 51 of the housing 33 eccentrically to the longitudinal axis 36. The opening 52 with the opening 43 form a second passage 53 through which a fluid flow Q2 can flow from the pressure chamber 40 into the outer chamber 44. The fluid flow Q2 divides in a fluid flow Q2 which flows through the opening 52 behind the closing element 34 into a region 54. From the region 54, a fluid stream Q4 as a so called leakage flow flows into a region 56 into which a pressure P3 acts. The leakage flow Q4 is determined by the cross-sectional relation between the inner diameter of the housing 33 and the closing element 34. The liquid flow Q4 flows through the opening 43 into the outer chamber 44. In this outer chamber a pressure P4 acts. During a subsequent turning-on of the fuel feeding aggregate 16 it is first necessary to remove the gas from the conduit system. The pressure chamber communicates initially with the outer chamber 44 through the passage 49 which is formed through by the openings 48 and 43. Thereby the feeding aggregate 16 can run without a counter pressure and in some cases displace the available gas out. No significant pressure can build up first in the pressure chamber 40. When after starting of the pump aggregate 16 the pressure chamber 40 is filled with fluid or the feeding aggregate 16 is initially completely emersed in the fluid, when the fuel level is located above the feeding aggregate 16, then the fluid flow Ql flows first through both openings 48, 43 into the outer chamber 44 without building up in the pressure chamber a counter pressure which is substantial relative to the pump power.

This increasing fluid flow Ql, the pressure P2 in the region 54 is smaller than the pressure P1 in the pressure chamber 40. Thereby a fluid flow Q3 flows increasingly through the opening 52 in the region 54. The pressure difference is produced since by the fluid flow Q1 a fluid flow Q4 flows at the closing element 34 because of the Venturi principle through the opening 43 into the outer chamber 44. With the negative pressure produced in the region 54 the fluid flow Q3 is greater than the fluid flow Q4 which flows between the closing element 34 and the housing 33 and is available as a saw-called leakage stream. Thereby the closing element 34 moves in direction of the arrow 47 from the opening position 46 of the valve seat 39.

The pressure P2 built under the closing element 34 is produced from the difference of the pressure P3 in the region 56 and the quotient from the gravity force of the closing element 34 and/or the force of the restoring means 62 in relation to the cross-sectional surface of the closing element 34. This pressure difference is dependent from the through-flow quantity of the fluid stream Ql and the size of the opening 48.

FIG. 4 shows a position between an opening position 46 and a closing position 66 of the closing element 34. Because of the fluid stream Q3 which flows into the region 54, the region 54 is slowly filled behind the closing element 34. The pressure P1 in the pressure chamber 40 remains at least on a low level since the pressure chamber 40 communicates through the openings 48, 43 with the outer chamber 44. Because of the pressure drop between the region 56 and 54, the closing element 34 is further moved to the valve seat 39. The closing movement of the closing element 43 is therefore a function of the fluid flow Q2 which is composed of the fluid flow Q3 and Q4.

FIG. 5 shows the closing element 34 in a closing position 66. In this position the pressure P1 in the pressure chamber 40 increases to the system pressure of the feeding aggregate 16. Because of the pressure difference between the pressure P4 in the outer chamber 44 and the pressure P1 in the pressure chamber 40. The closing element 34 is pressed in the valve seat 39 and seals the pressure chamber 40 from the outer chamber 44.

The closing time for the closing movement of the closing element 34 from the opening position 46 into the closing position 66 is determined by the cross-section of the opening 48 and the opening 52. In dependence on the cross-sectional relationship, a pressure condition can be adjusted in dependence on time, whereby the closing speed can be determined. Moreover, the closing time is determinable by the relationship of the cross-sectional area of the closing element 34 to the inner diameter of the housing 33. Furthermore, a parameter for the closing time can be the restoring force of the restoring means 62 since the closing element 34 must be moved against this force. Furthermore, the closing time, in particular in a standing arrangement, is influenceable by the weight force of the closing element 34. Moreover, the position of the closing path is a further parameter for the closing time. Substantially however the closing time is determinable by the openings 48 and 52 acting as throttles. The inventive valve 32 provides a time-dependent closure valve.

In accordance with a further alternative embodiments which are not shown in the drawings, the closing element can be formed as a magnetic valve or the like.

Figure 6:
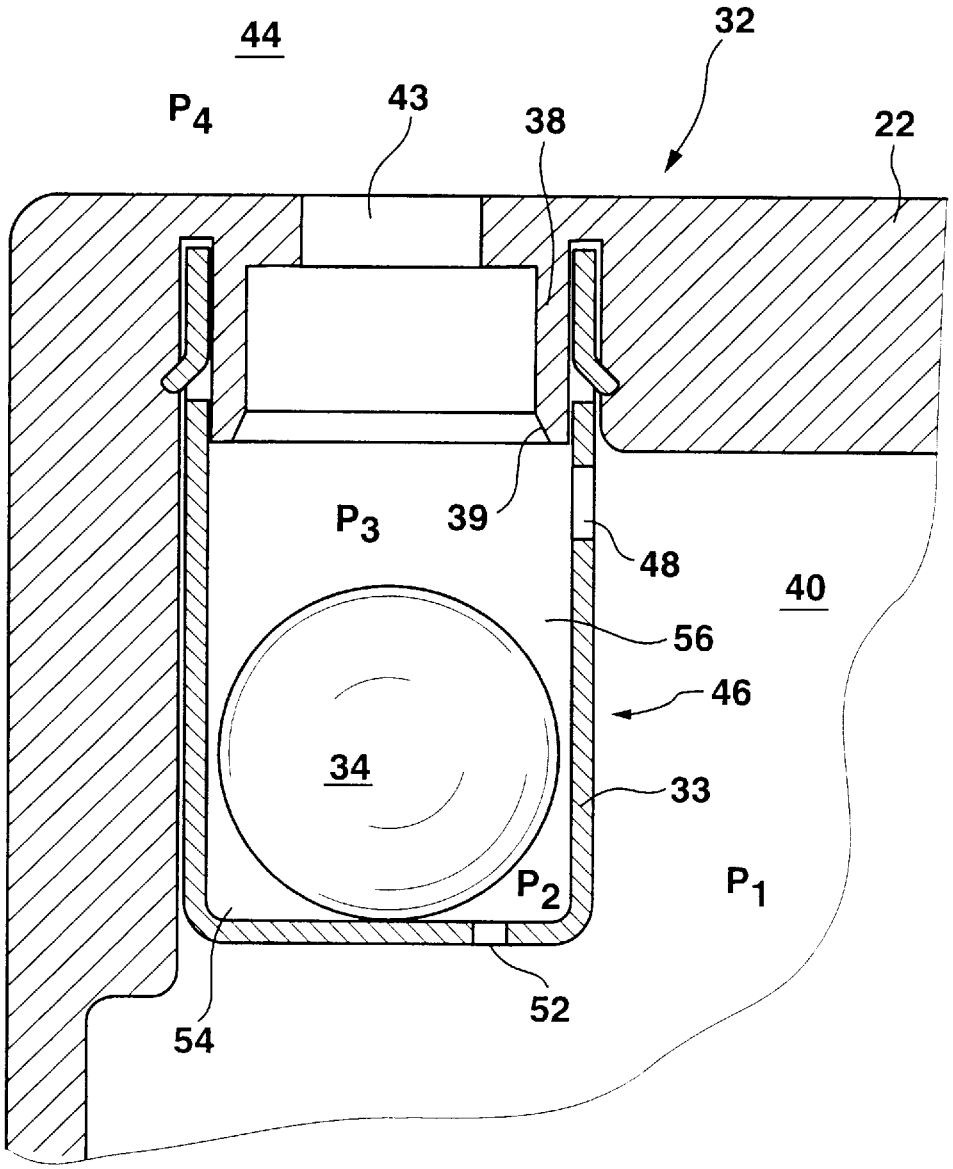
FIG. 6 is a view schematically showing an alternative embodiment of the valve of FIG. 3.

FIG. 6 shows an alternative embodiment of a valve 32 of FIG. 3. In this embodiment in deviation from the embodiment shown in FIG. 3, an insert 38 which is of one-piece with the housing cover 22 is provided with a valve seat 39. Therefore a component-reduced embodiment when compared with the valve 32 of FIG. 3 is provided. The remaining features of the valve 32 correspond to the valve described in FIGS. 3–7.

Figure 7:
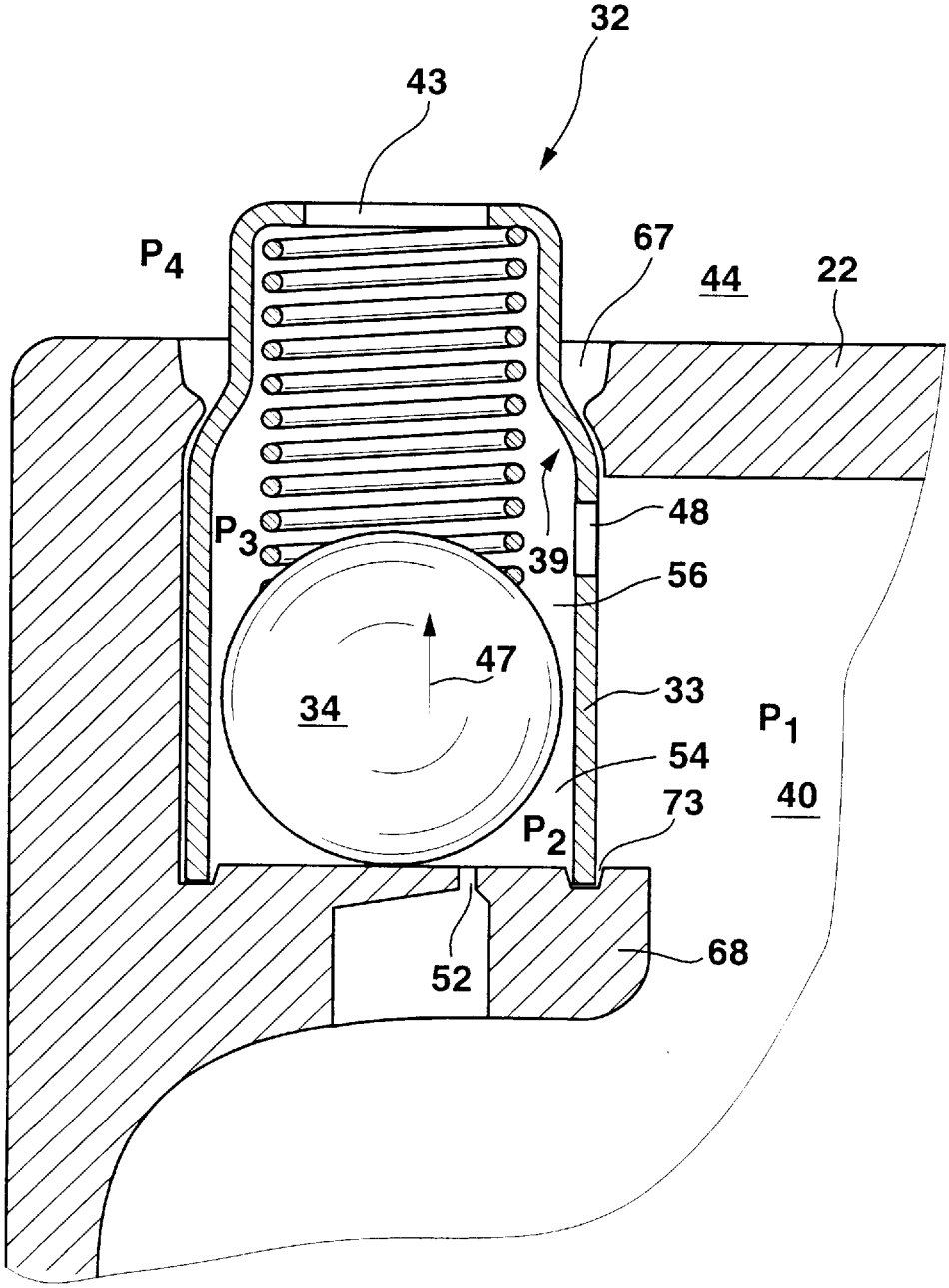
FIG. 7 is a view showing a further alternative embodiment of the valve of FIG. 3.

FIG. 7 shows a further alternative embodiment of a valve 32. The valve 32 has a housing 33. A valve seat 39 and an opening 43 to the outer chamber 44 is integrated in the housing 33. The housing 33 is inserted from the outer chamber 44 into an opening 67 of the housing cover 62 and located on a shoulder formed on the housing cover 22. For simpler positioning of the housing 32, depressions 33 or recesses can be formed on the shoulder 68. For fixing the housing 33, after the insertion the opening 67 is deformed so that the housing 33 is secured from lifting from the opening 67. The edge region of the opening 67 can be treated by deformation, by heat flanging or further features, so that the edge regions of the opening 67 are engaged by the narrowing of the housing 33 which forms the valve seat 39.

Figure 8:
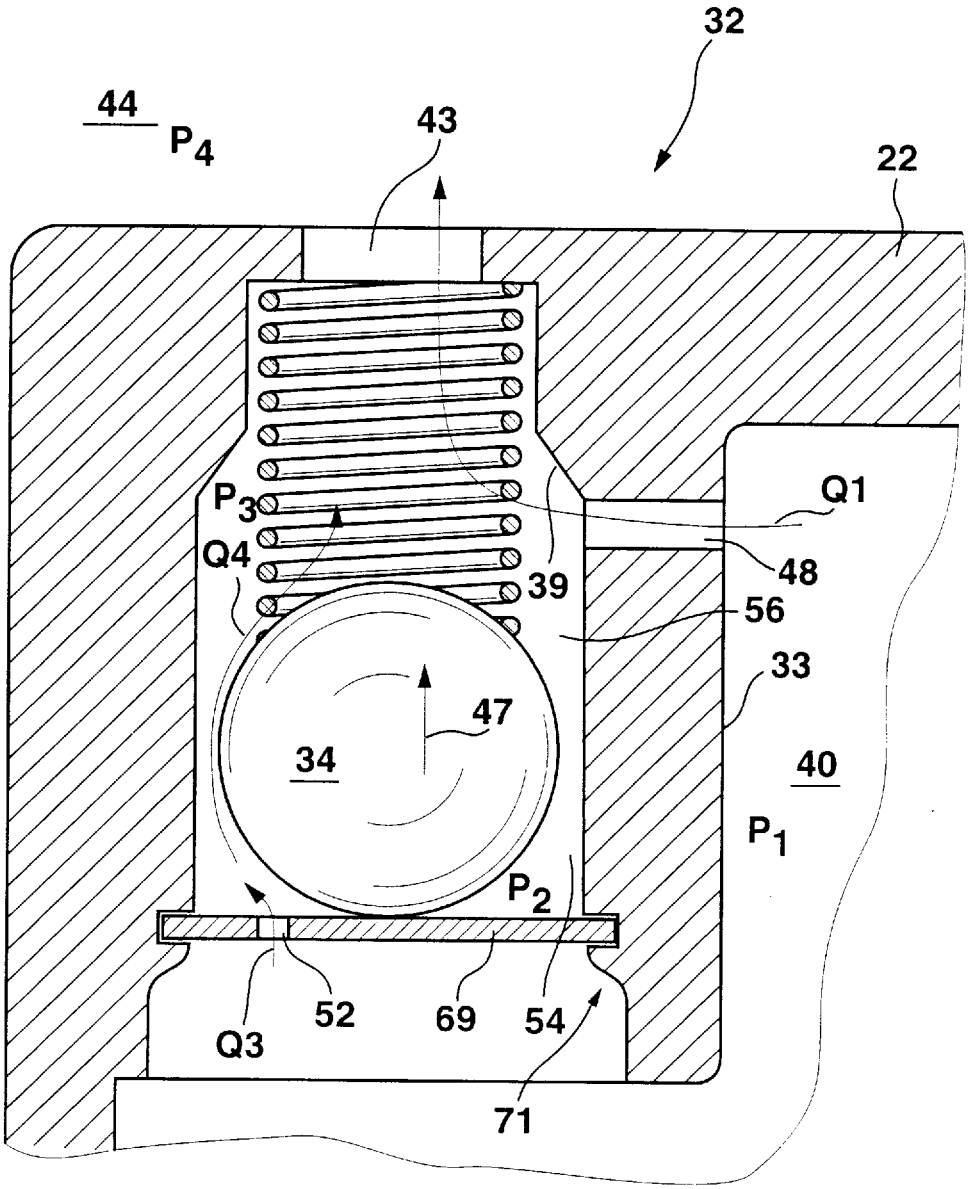
FIG. 8 is a view showing a further alternative embodiment of the valve of FIG. 3.

A further alternative embodiment which is different from the valve 32 of FIG. 3 is shown in FIG. 8. In this embodiment, the valve housing 33 is integrated in the housing cover 22 and can be formed together with the housing cover 22 as an injection molded part. The closing element 34 is inserted in the housing 33 and arranged by a holding element 69 in the housing. The holding element 69 can be composed of a metal disk or a synthetic plastic disk which has an opening 52. The holding elements 9 can be inserted in an opening 71 of the housing 33 and then fixed by heat wedging, forced deformation and the like in the housing cover 22. Alternatively, the holding element 69 can be clamped or glued in the housing cover 22 as well as pressed in it.

It will be understood that each of the elements described above, or two or more together, may also find a useful application in other types of constructions differing from the types described above.

While the invention has been illustrated and described as embodied in aggregate for feeding fuel from supply tank to internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

We claim:

1. An aggregate for feeding fuel from a fuel supply tank to an internal combustion engine, the aggregate comprising a housing through which fuel flows; a feeding pump and a motor which drives said pump, said feeding pump and a motor which drives said pump, said feeding pump and said motor being arranged in said housing so that behind said feeding pump as considered in a flow direction a pressure chamber limited by said feeding pump is provided; a valve communicating said pressure chamber with an outer chamber, said valve having a closing element which during a normal operation of said feeding aggregate is held in a closing position so that said pressure chamber is filled with fuel and separated from said outer chamber, said valve having a first passage with a first fluid flow which directly communicates said pressure chamber with said outer chamber when said valve is in open position, a second passage with a second fluid flow flowing around said closing element and leading to a joint opening toward said outer chamber, so that with increasing first fluid flow a pressure difference on opposite sides of said closing element.

2. An aggregate as defined in claim 1, wherein said valve has a valve housing which receives said closing element, said valve housing having a first recess and a second recess toward said pressure chamber provided before and after said closing element arranged in the opening position as seen in the closing direction.

3. An aggregate as defined in claim 2, wherein said first passage is formed between said opening and said first recess.

4. An aggregate as defined in claim 2, wherein said second passage is formed between said opening and said second recess.

5. An aggregate as defined in claim 1, wherein said closing element is guided in said valve housing with a gap therebetween.

6. An aggregate as defined in claim 2, wherein said valve housing is cup-shaped and has a first housing cover provided with a valve seat.

7. An aggregate as defined in claim 2, wherein said valve housing of said valve is cup-shaped and has an insert provided with a valve seat, said valve housing having a housing cover provided with an opening, said valve seat being arrangeable toward said opening.

8. An aggregate as defined in claim 2, wherein said housing has a housing cover; and further comprising means for mounting said housing on said housing cover and including an arresting connection.

9. An aggregate as defined in claim 2, wherein said housing has a housing cover; and further comprising means for mounting said housing on said housing cover and including a snapping connection.

10. An aggregate as defined in claim 2, wherein said housing has a housing cover; and further comprising means for mounting said housing on said housing cover and including an arresting and snapping connection.

11. An aggregate as defined in claim 1, wherein said valve has a cup-shaped valve housing with a closed end provided with a valve seat and with an opening, and a housing cover which covers said opening, said valve being mountable by deformation of an edge region of said opening of said cover.

12. An aggregate as defined in claim 1, wherein said valve has a valve housing and a housing cover which are formed of one-piece with one another; and further comprising a holding element having an opening and closing said housing.

13. An aggregate as defined in claim 1, wherein said valve has a valve housing composed of synthetic plastic material.

14. An aggregate as defined in claim 1, wherein said valve has a valve housing composed of metal.

15. An aggregate as defined in claim 1, wherein said valve has restoring means for urging said closing element to said opening position.

16. An aggregate as defined in claim 2, wherein said second recess is eccentric to a longitudinal axis of said valve housing.

17. An aggregate as defined in claim 2, wherein said first recess and said second recess have cross-sections which are in such a relation to one another as to determine a closing time of said valve.

18. An aggregate as defined in claim 1, wherein said pressure chamber has a first pressure, and a region behind said closing element as considered in the closing direction has a second pressure, said pressure chamber in said region being formed so that a pressure difference between said first pressure and said second pressure determines a closing time of said valve.

19. An aggregate as defined in claim 1, wherein a third pressure acts in a region, and said closing element has a weight force and a cross-sectional area selected so that a difference of said third pressure in said region and a quotient of one of said weight force of said closing element and a restoring force of restoring means to a cross-sectional area of said closing element determines a closing time of said valve.

20. An aggregate as defined in claim 1, wherein a third pressure acts in a region, and said closing element has a weight force; and further comprising a restoring means having a restoring force selected so that a difference of said third pressure in said region and a quotient of said weight force of said closing element and said restoring force of said restoring means to a cross-sectional area of said closing element determines a closing time.

21. An aggregate as defined in claim 1, wherein said closing element has a closing path determining a closing time of said valve.

* * * * *